US008365937B2

(12) United States Patent
Lovelace et al.

(10) Patent No.: US 8,365,937 B2
(45) Date of Patent: Feb. 5, 2013

(54) PORTABLE RESERVOIR FRAME

(75) Inventors: Sean Michael Lovelace, Casper, WY (US); Christopher Jason Songe, Casper, WY (US)

(73) Assignee: Energy Innovations, LLC, Casper, WY (US)

( * ) Notice: Subject to any disclaimer, the term of this patent is extended or adjusted under 35 U.S.C. 154(b) by 0 days.

(21) Appl. No.: 13/469,845

(22) Filed: May 11, 2012

(65) Prior Publication Data

US 2012/0234829 A1 Sep. 20, 2012

Related U.S. Application Data

(63) Continuation of application No. 13/426,286, filed on Mar. 21, 2012, which is a continuation-in-part of application No. 13/245,492, filed on Oct. 21, 2011.

(51) Int. Cl.
*B65D 6/00* (2006.01)

(52) U.S. Cl. ..... 220/4.17; 220/4.16; 220/693; 220/567; 220/4.12

(58) Field of Classification Search ..... 220/565, 220/567, 1.6, 4.16, 4.12, 9.4, 495.06, 495.08, 220/23.9, 4.17, 693, 681
See application file for complete search history.

(56) References Cited

U.S. PATENT DOCUMENTS

| | | | | | |
|---|---|---|---|---|---|
| 1,076,382 | A | * | 10/1913 | Maloney | 220/4.17 |
| 1,875,666 | A | * | 9/1932 | Schwemlein | 220/693 |
| 2,123,035 | A | * | 7/1938 | Ashley | 220/693 |
| 2,914,149 | A | * | 11/1959 | Walker | 52/394 |
| 3,233,251 | A | * | 2/1966 | Barrera | 52/245 |
| 3,562,822 | A | * | 2/1971 | Wall | 52/245 |
| 3,648,303 | A | * | 3/1972 | Stewart et al. | 52/5 |
| 3,736,599 | A | * | 6/1973 | Kessler et al. | 52/169.7 |
| 3,793,651 | A | * | 2/1974 | Pitti et al. | 52/169.7 |
| 3,819,079 | A | * | 6/1974 | Levens | 220/4.13 |
| 4,048,773 | A | * | 9/1977 | Laven | 52/169.7 |
| 4,124,907 | A | * | 11/1978 | Laven | 52/169.7 |
| 4,223,498 | A | * | 9/1980 | Ventrice | 52/249 |
| 4,240,562 | A | * | 12/1980 | Holschlag | 220/565 |
| 4,860,914 | A | * | 8/1989 | Derni et al. | 220/4.28 |
| 4,932,558 | A | * | 6/1990 | Katavolos | 220/666 |
| 5,054,135 | A | * | 10/1991 | Dallaire et al. | 4/506 |
| 5,161,264 | A | * | 11/1992 | Dugas | 4/506 |
| 5,294,019 | A | * | 3/1994 | Looker | 220/683 |
| 6,071,213 | A | * | 6/2000 | Raasch et al. | 482/29 |
| 7,311,827 | B2 | * | 12/2007 | Clark et al. | 210/232 |
| 7,766,184 | B2 | * | 8/2010 | Avery et al. | 220/573.1 |
| 7,918,764 | B2 | * | 4/2011 | VanElverdinghe | 482/27 |
| 2009/0127255 | A1 | * | 5/2009 | Rood, Jr. | 220/1.5 |

FOREIGN PATENT DOCUMENTS

| | | |
|---|---|---|
| CA | 2692016 | 7/2010 |

* cited by examiner

*Primary Examiner* — Anthony Stashick
*Assistant Examiner* — Christopher McKinley
(74) *Attorney, Agent, or Firm* — Gordon Silver Ltd.; Ronald C. Gorsché

(57) ABSTRACT

A portable reservoir frame having a number of interlocking panels secured by a plurality of interleaved knuckle members is provided.

20 Claims, 20 Drawing Sheets

PORTABLE RESERVOIR FRAME

FIELD OF THE INVENTION

This invention relates generally to a reservoir frame capable of being transported to various geographical areas, placed on or in the ground and able to provide containment for various liquids.

BACKGROUND OF THE INVENTION

Often in various industries is necessary to hold and contain various industrial liquids from process activity. In the oil and gas industry, for example, it is often necessary to contain fracturing fluid, which is a byproduct of drilling activity. Currently, trailers are used to hold and contain this liquid.

To accommodate oil and gas production in the field, a trailer is transported to the site where the liquid is produced. The trailers often have a 500 barrel capacity, so multiple trailers are needed in situations where much liquid is stored.

The cost of trucking trailers to various oil and gas drilling locations is significant. Additionally, transporting the liquid from the production site adds to the already high cost of oil and gas drilling operations. Furthermore, environmental concerns associated with numerous containment trailers for the liquid has generated governmental regulations, including rules regarding environmental quality, transportation, safety and health, etc.

SUMMARY OF THE INVENTION

One embodiment of the invention comprises a portable reservoir frame comprising two or more panels. Each of the panels comprises a plate having an outer surface, an inner surface, a top edge, a bottom edge, a first edge and a second edge. A first plurality of knuckle members is secured to the first edge of the panel. Each knuckle member has at least one hole for receiving a securing member. A second plurality of knuckle members is secured to the second edge of the panel. The second plurality of knuckle members also has at least one hole for receiving a securing member. The second plurality of knuckle members is configured to be interleaved with the first plurality of knuckle members of an adjacent panel of the reservoir frame. The knuckle members are secured with a securing member, sized to fit within the at least one hole of each knuckle member of the first plurality and the second plurality of knuckle members.

In an alternate embodiment, a method of constructing a portable reservoir frame comprising two or more panels is provided. In general, the method comprises providing a plurality of panels, where each panel has a plate with an outer surface, an inner surface, a top edge, a bottom edge, a first edge and a second edge. A first plurality of knuckle members is secured to the first edge of the plate and each has at least one hole for receiving a securing member. A second plurality of knuckle members is secured to the second edge of the plate and each has at least one hole for receiving a securing member. The second plurality of knuckle members of a panel are configured to be interleaved with the first plurality of knuckle members of an adjacent panel of the reservoir frame and secured with a securing member sized to fit within the at least one hole of each knuckle member of the first plurality and the second plurality of knuckle members. The panel is also provided with a plurality of crossbars secured to the outer surface of the panel for receiving a quick attachment plate coupled to a lifting device.

The method continues by removably coupling a quick attachment plate coupled to a lifting device with the plurality of crossbars secured to the outer surface of a panel so as to provide the means for lifting the panel with the lifting device and positioning the panel adjacent another panel of the plurality of panels. Adjacent panels are secured together by interleaving the first plurality of knuckle members of the panel with the second plurality of knuckle members of the adjacent panel and inserting a securing member into the at least one hole of each knuckle member of each panel to secure the adjacent panels. The steps of coupling, lifting, positioning, interleaving and inserting are repeated until the portable reservoir frame is fully constructed.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
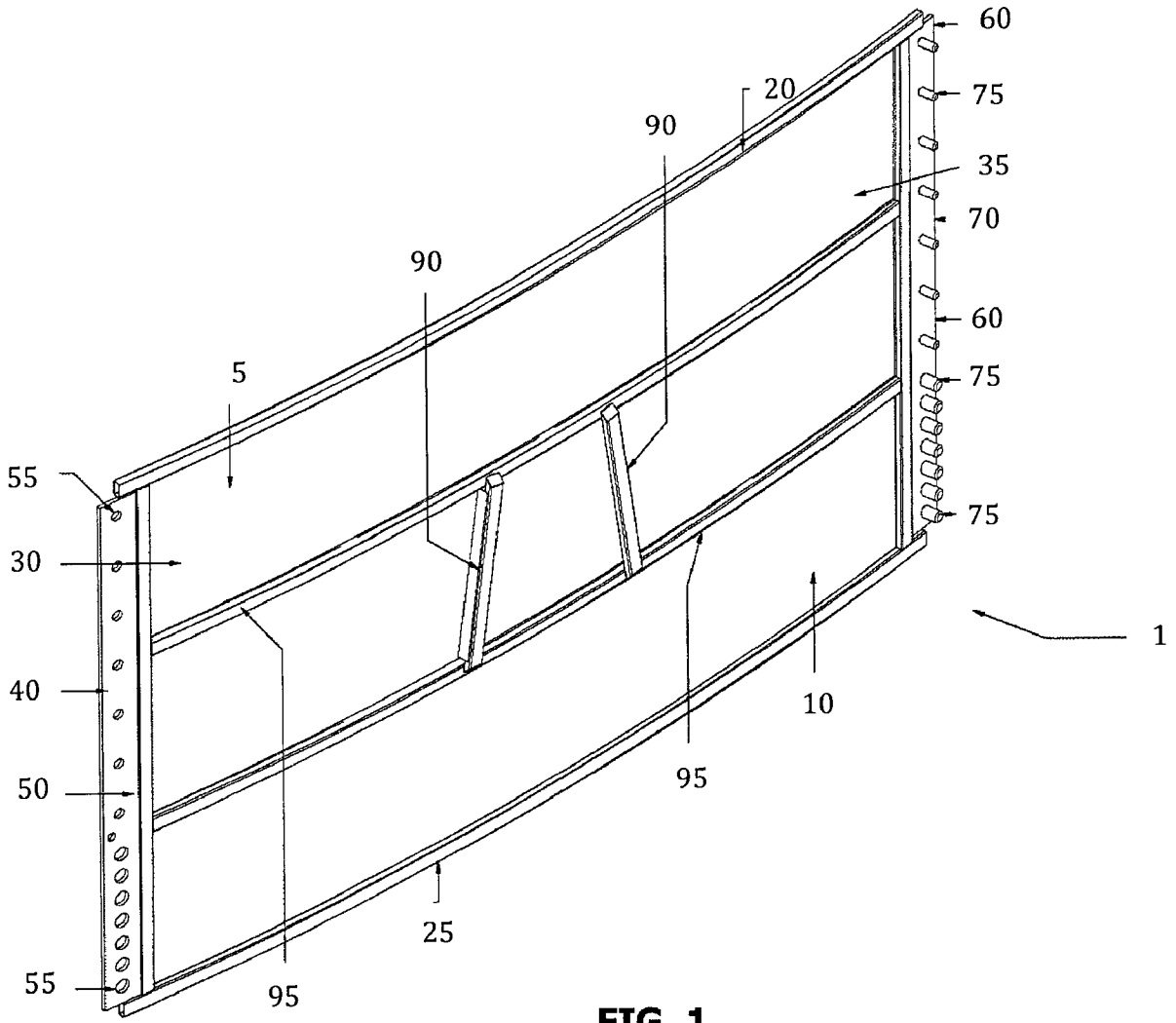
FIG. 1 illustrates a perspective view of one embodiment of the present invention showing a panel having an outer surface, first and second flanges and top edge.

Reference will now be made in detail to embodiments of the invention, examples of which are illustrated in the accompanying drawings. Throughout the following detailed description, the same reference characters refer to the same or similar elements in all figures.

FIG. 1 illustrates a perspective view of one embodiment of the present invention showing a panel 1 having plate 5. As depicted in FIG. 1, the plate 5 of the panel 1 has an outer surface 10, a top edge 20, and a bottom edge 25. The bottom edge 25 is adapted to be disposed upon a ground surface. The plate 5 is attached to a first flange 40 at the first edge 30 of the plate 5. The plate 5 is attached to the second flange 60 at the opposing second edge 35 of the plate 5. FIG. 1 depicts the outer face 50 of the first flange 40 and the outer face 70 of the second flange 60.

FIG. 1 illustrates the first flange 40 having holes 55. In one embodiment of the present invention, the holes 55 are unevenly spaced, having a higher density of holes 55 toward the bottom of the first flange 40. The second flange 60 has pegs 75. In one embodiment, the pegs 75 extend in direction normal to the outer face 70 of the second flange 60 and are adapted for penetration of the holes 55. Similar to the holes 55 and in one embodiment of the present invention, the pegs 75 are unevenly spaced with a higher density of pegs disposed at the bottom of the second flange 60. The higher density of holes 55 and corresponding pegs 75 disposed toward the bottom of the first and second flanges provides for and accommodates more water to be placed in the reservoir. The additional water places more pressure toward the bottom of the flanges and a higher density of holes and pegs stabilize the bottom portion of the structure and further secures the connection between interconnected panels. In many embodiments of the present invention, the pegs 75 are integrally formed with the second flange 60.

FIG. 1 illustrates crossbars 90 that are used to attach temporarily a panel connector piece of a front end loader or telehandler for transportation. Thus, a front end loader or telehandler can easily manipulate and transport a panel during reservoir frame construction. In one embodiment, the crossbars 90 may be attached to the outer surface 10 of the panel 1. Additionally, FIG. 1 depicts horizontal support beams 95 to further secure and strengthen the panel 1 and plate 5. The horizontal support beams 95 are generally parallel to the top edge 20 and the bottom edge 25, and the horizontal support beams are disposed between the first edge 30 and opposing second edge 35. In another embodiment the crossbars 90 may be attached to the horizontal support beams 95.

In one embodiment of the present invention the panels have a curvature such that when numerous panels are interconnected via the pegs 75 and holes 55, a generally circular reservoir frame system is constructed. The curvature is generally convex relative to the outer surface and concave relative to the inner surface.

In various embodiments of the present invention, the first flange 40 is integrally formed with the plate 5. Likewise, the second flange 60 is integrally formed with the plate 5, in many embodiments of the present invention.

Figure 2:
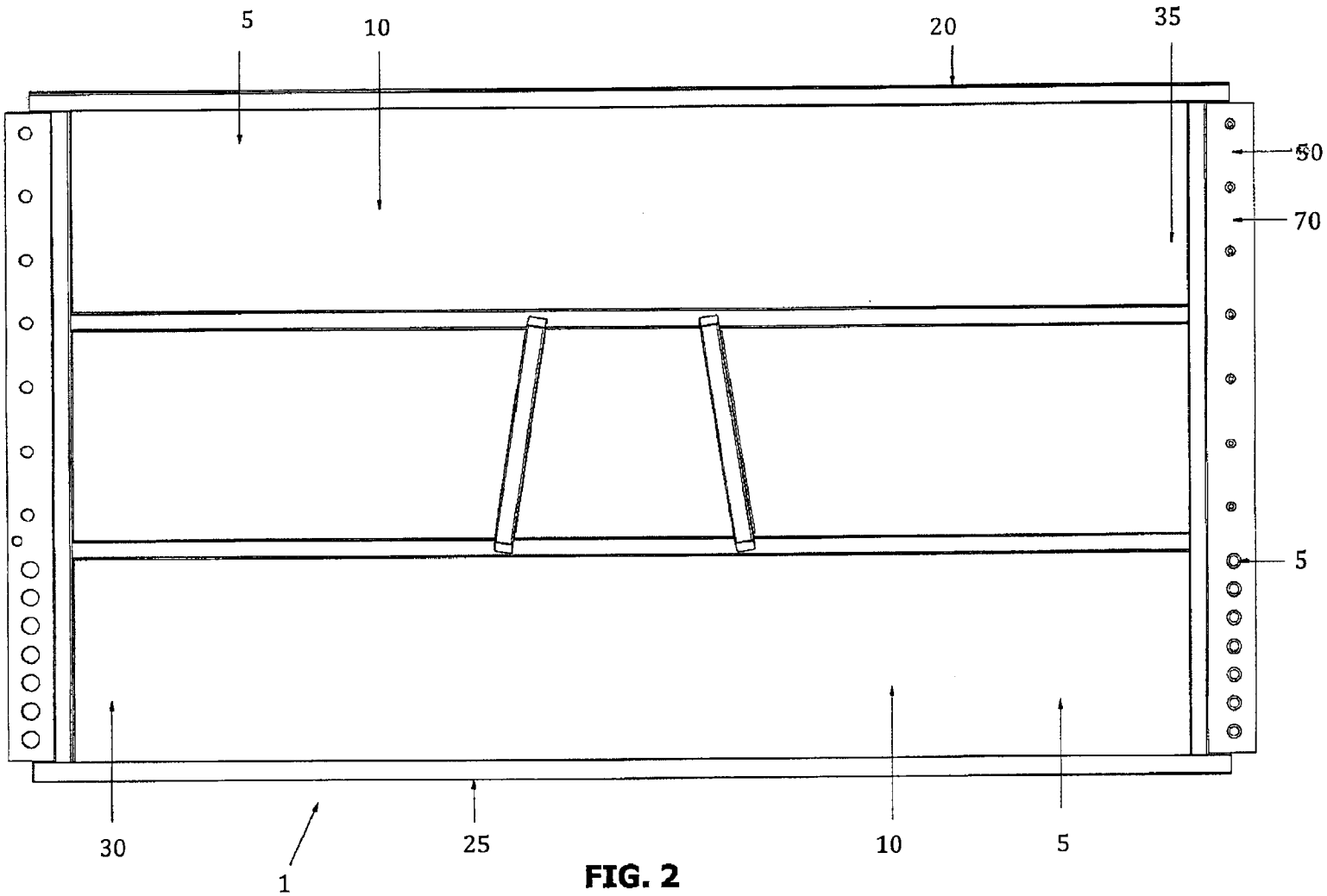
FIG. 2 illustrates a front view of the top of the embodiment of the present invention shown in FIG. 1 hereof.

FIG. 2 illustrates a front view of the top of the embodiment of the present invention as depicted in FIG. 1. FIG. 2 further depicts the pegs 75 and holes 55 having a higher density of both at the bottom portion of the flange. FIG. 2 shows one embodiment of the present invention wherein the pegs 75 and corresponding holes 55 have a larger diameter toward the bottom portion of the first flange 40 and the second flange 60. This further secures connection between panels because the lower, larger diameter pegs 75 have additional sheer strength and are able to accommodate greater pressures against the inner surface of the panel 1.

Figure 3:
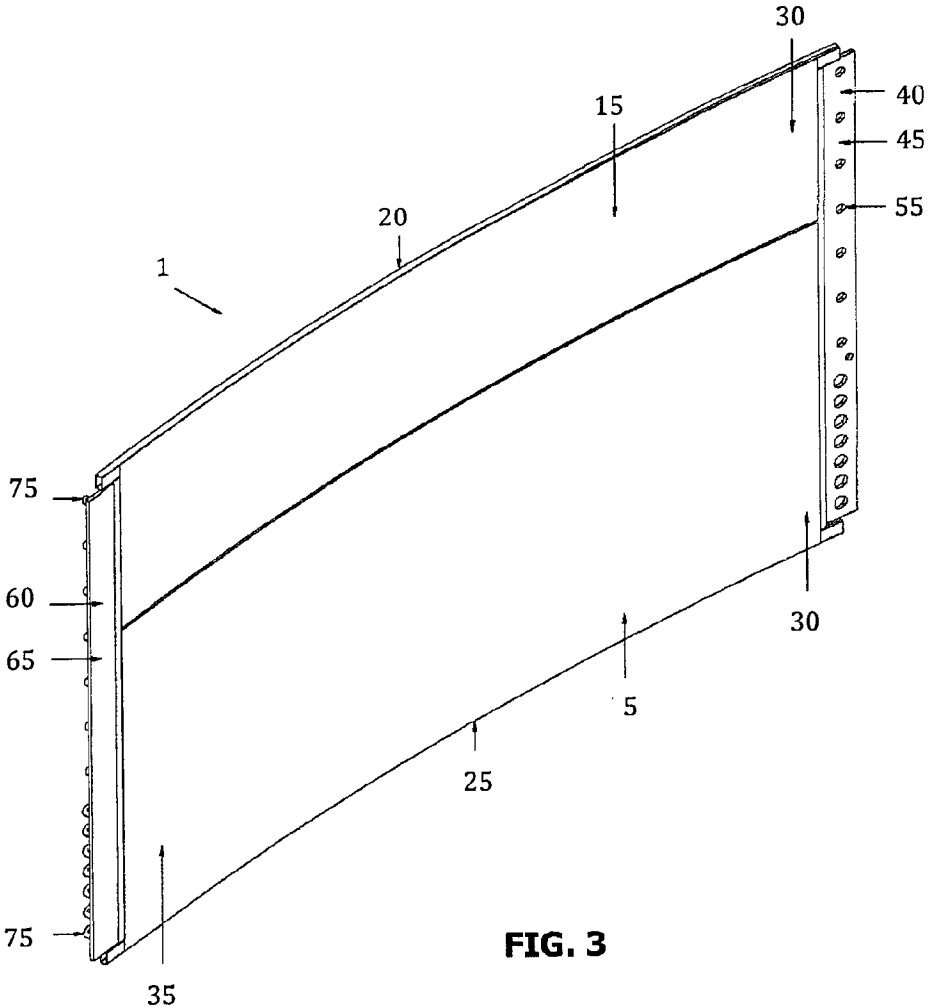
FIG. 3 illustrates another perspective view of the embodiment of the present invention shown in FIG. 1 and FIG. 2 hereof, further showing the inner surface, first and second flanges and top edge.

FIG. 3 depicts the inner surface 15 of the plate 5 of the panel 1 having a top edge 20 and a bottom edge 25. The plate 5 is attached to the first flange 40 at the first edge 30. The plate 5 is attached to the second flange 60 at the opposing second edge 35. FIG. 3 depicts the first flange inner face 45 and the second flange inner face 65. FIG. 3 illustrates the first flange 40 having holes 55. The second flange 60 has pegs 75.

Figure 4:
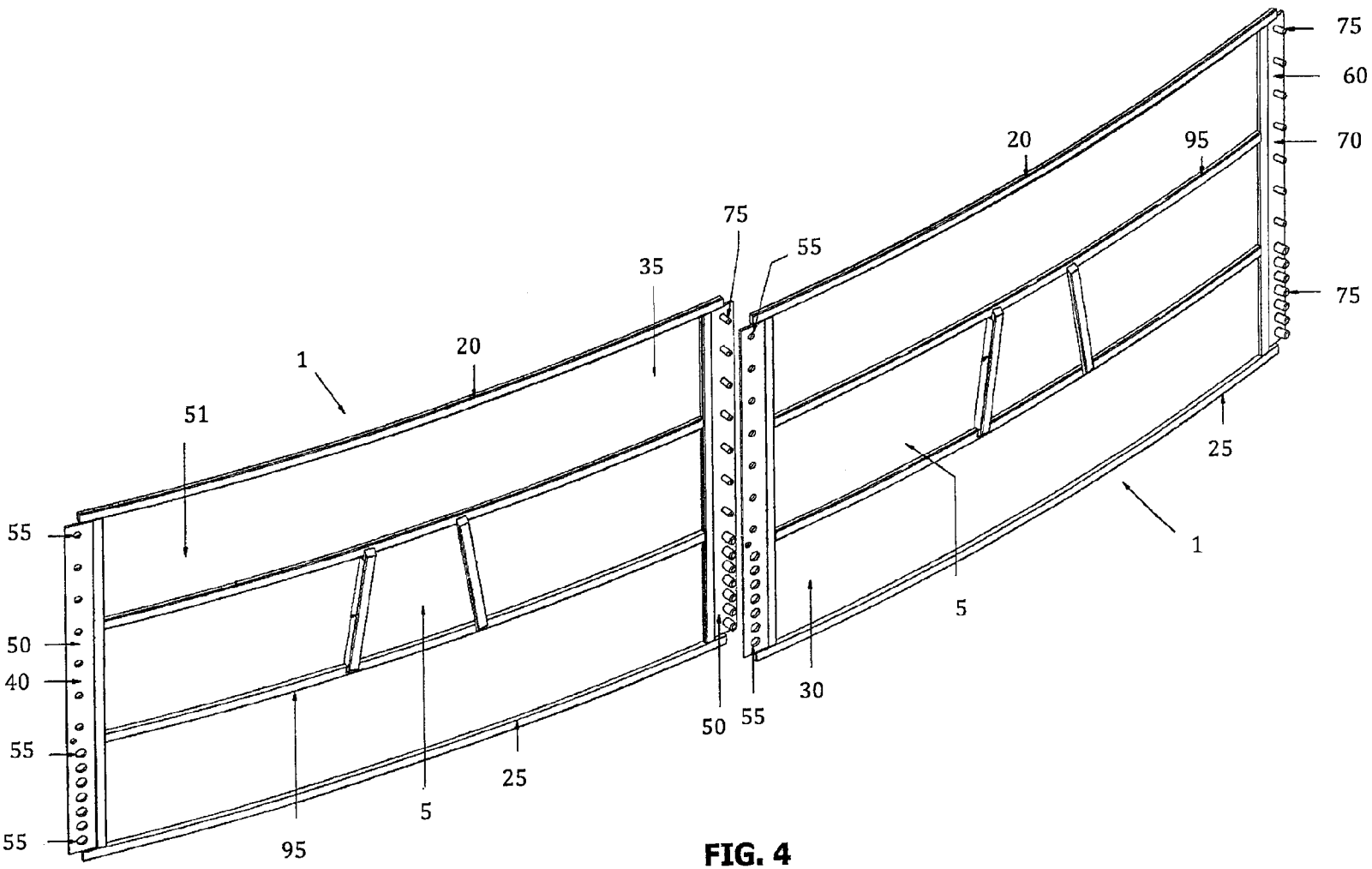
FIG. 4 illustrates a perspective view of yet another embodiment of the present invention as seen from the outer surface, further showing two panels prior to connection of the two panels.

FIG. 4 depicts a perspective view of the outer surface of two panels prior to connection of the two panels. The pegs 75 of the second flange 60 of one panel will penetrate the holes 55 of the first flange 40 of another panel. In this representation of the present invention the second flange outer face 70 is aligned opposite the first flange inner face 45 (not depicted).

Figure 5:
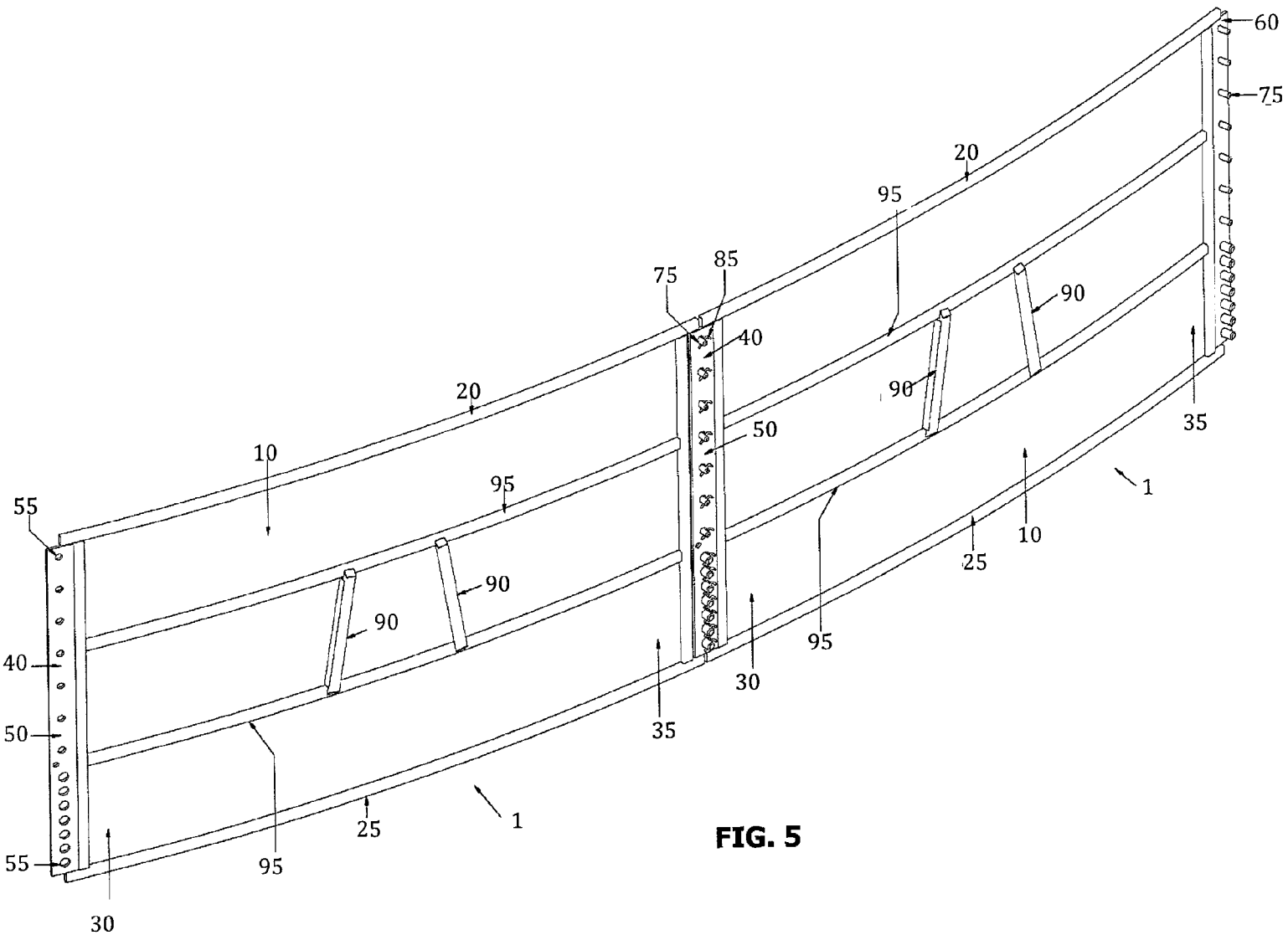
FIG. 5 illustrates a perspective view of yet another embodiment of the present invention as shown in FIG. 4, further showing two panels connected.

FIG. 5 depicts a perspective view of the outer surface after the connection of two panels. In this representation, the outer face 75 of the second flange 60 contacts the inner face (not depicted) of the first flange 40. The pegs 75 penetrate the holes 55. Furthermore, FIG. 5 depicts pins 85 penetrating the pegs 75 in order to further secure the interlocking panels.

Figure 6:
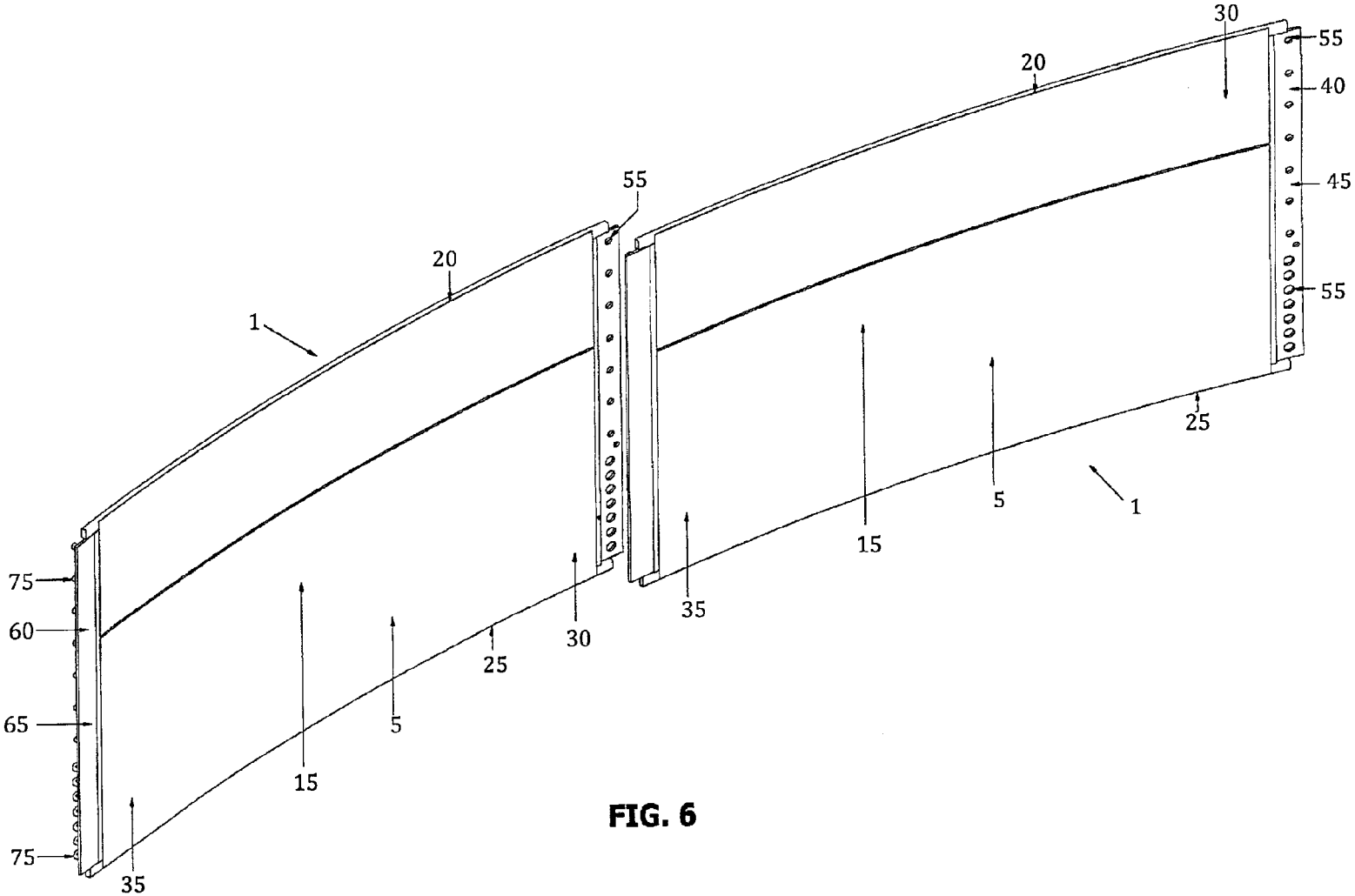
FIG. 6 illustrates a perspective view of yet another embodiment of the present invention as seen from the inner surface, further showing two panels prior to connection of two panels.

FIG. 6 depicts a perspective view of the inner surface of two panels prior to the interlocking connection. FIG. 6 is the inside view of the invention shown in FIG. 4, i.e., prior to connection of panels.

Figure 7:
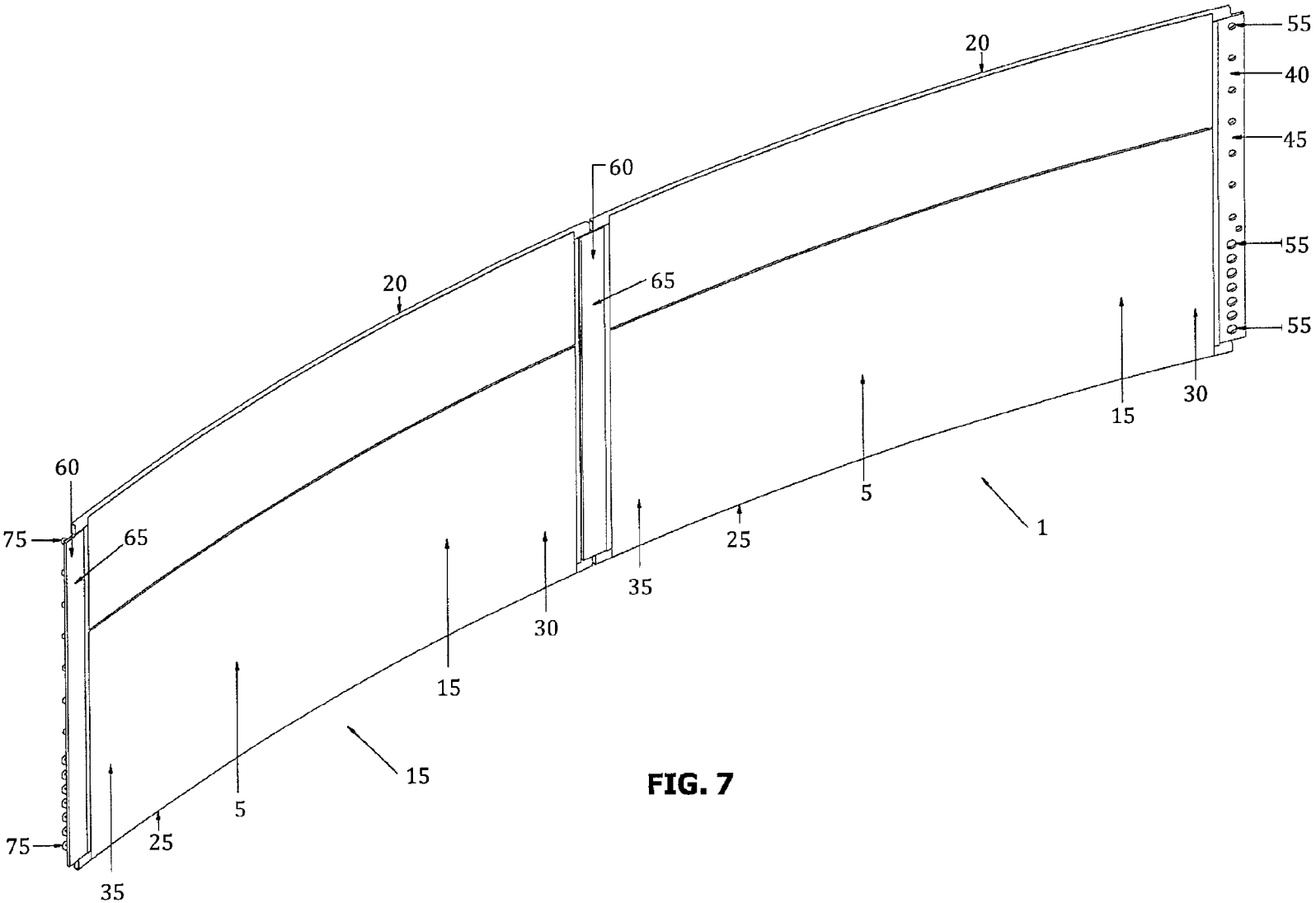
FIG. 7 illustrates a perspective view of yet another embodiment of the present invention as shown in FIG. 6, further showing two panels connected.

FIG. 7 depicts a perspective view of the inner surface after the connection of two panels. FIG. 7 depicts the inside view of the invention shown in FIG. 5, i.e., when connection of the panels occurs.

Figure 8B:
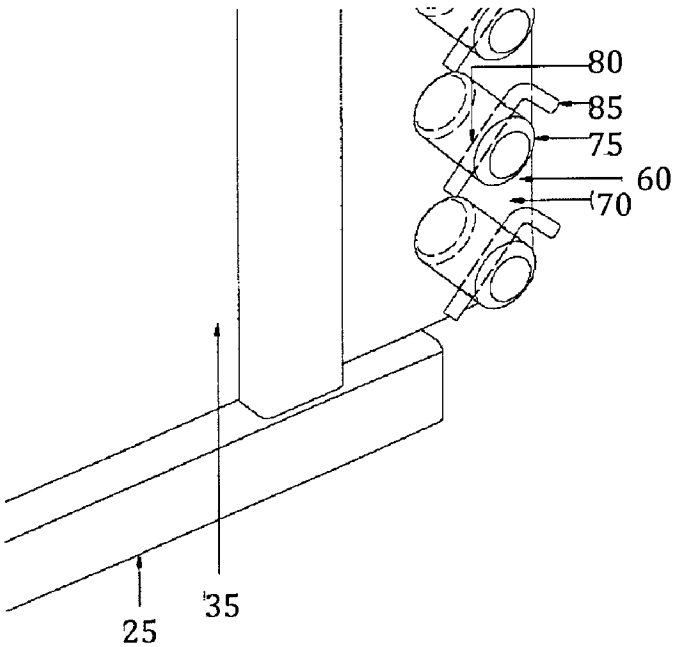
FIG. 8A and FIG. 8B illustrate a perspective view of one embodiment the pin connection mechanism which secures connection of the panel flanges.
Figure 8A:
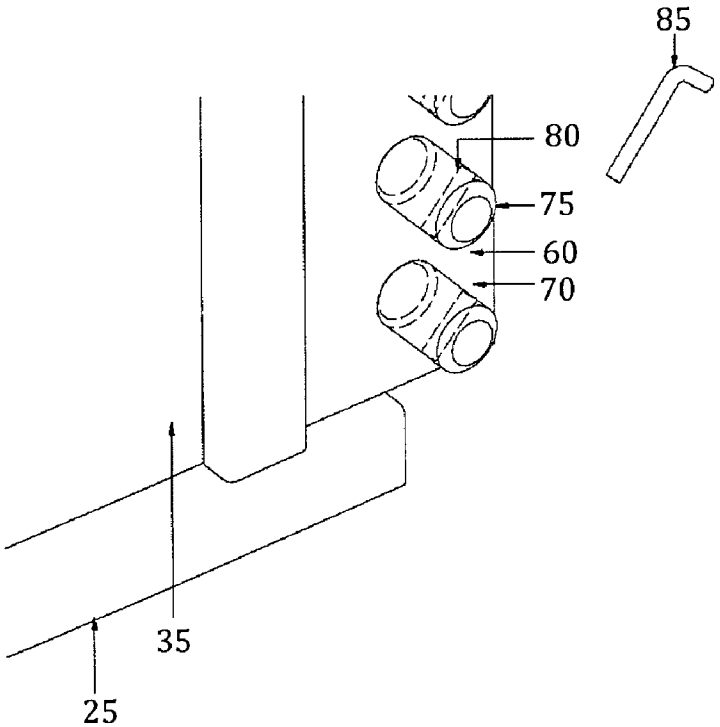

FIG. 8A depicts the pin 85 and the peg 75 with a cut out representation of the eyelet 80 to accommodate penetration of the pin 85. FIG. 8B more depicts the pin 85 penetrating the peg 75 through the eyelet as show previously in FIG. 8A. The pin 85 goes through the peg 75 via the eyelet 80 (not depicted). In one embodiment of the present invention, the eyelet 80 is at an angle of roughly 45° relative to the bottom edge 25.

Figure 9:
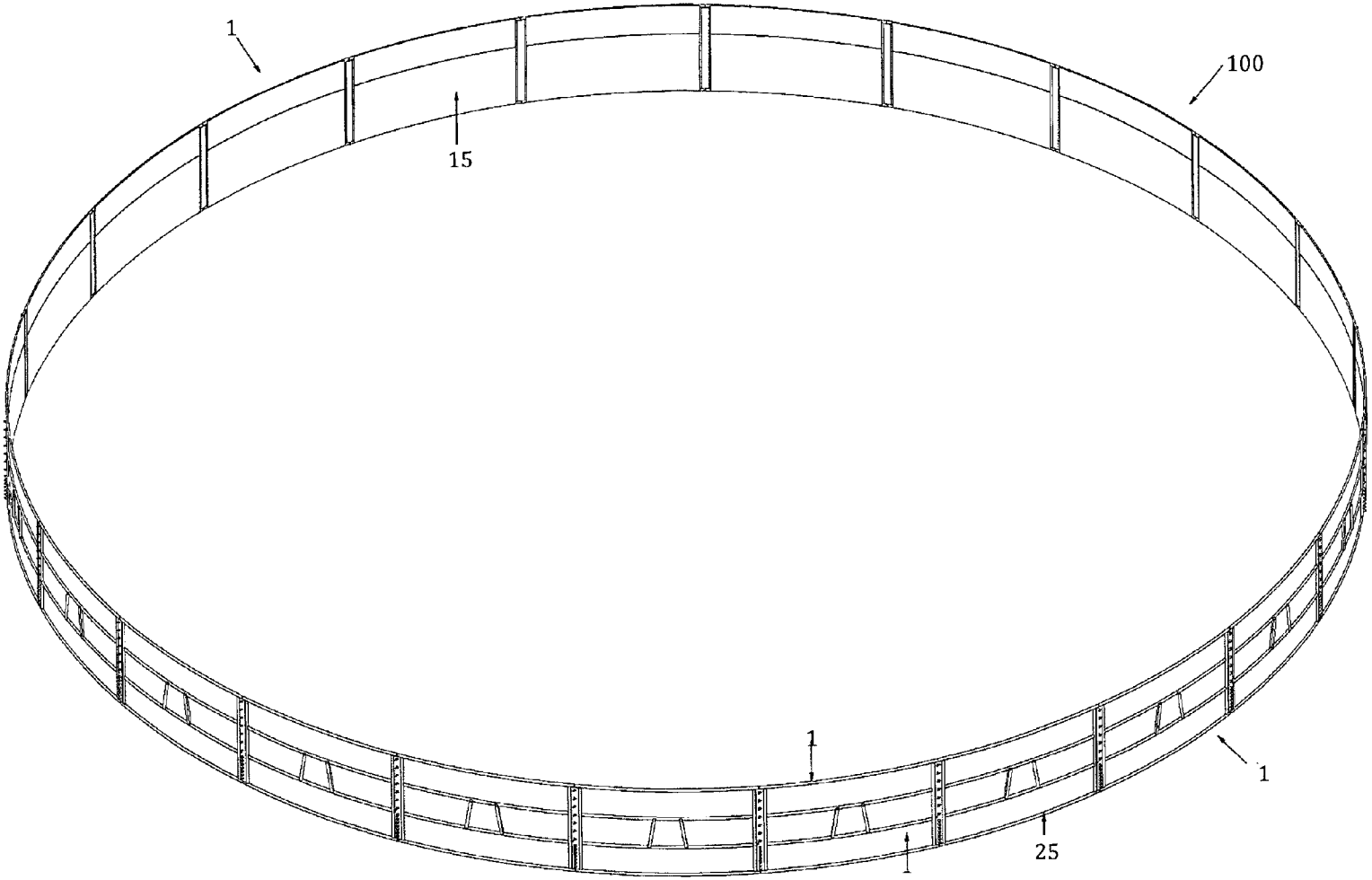
FIG. 9 illustrates a perspective view of one embodiment of the present invention showing panels fully connected and creating a circular reservoir of interlocking panels.

FIG. 9 depicts a top perspective side view of panels fully connected and creating a circular reservoir frame of interlocking panels. The interlocking panels form a variety of shapes in various embodiments, including oval and circles.

Figure 10:
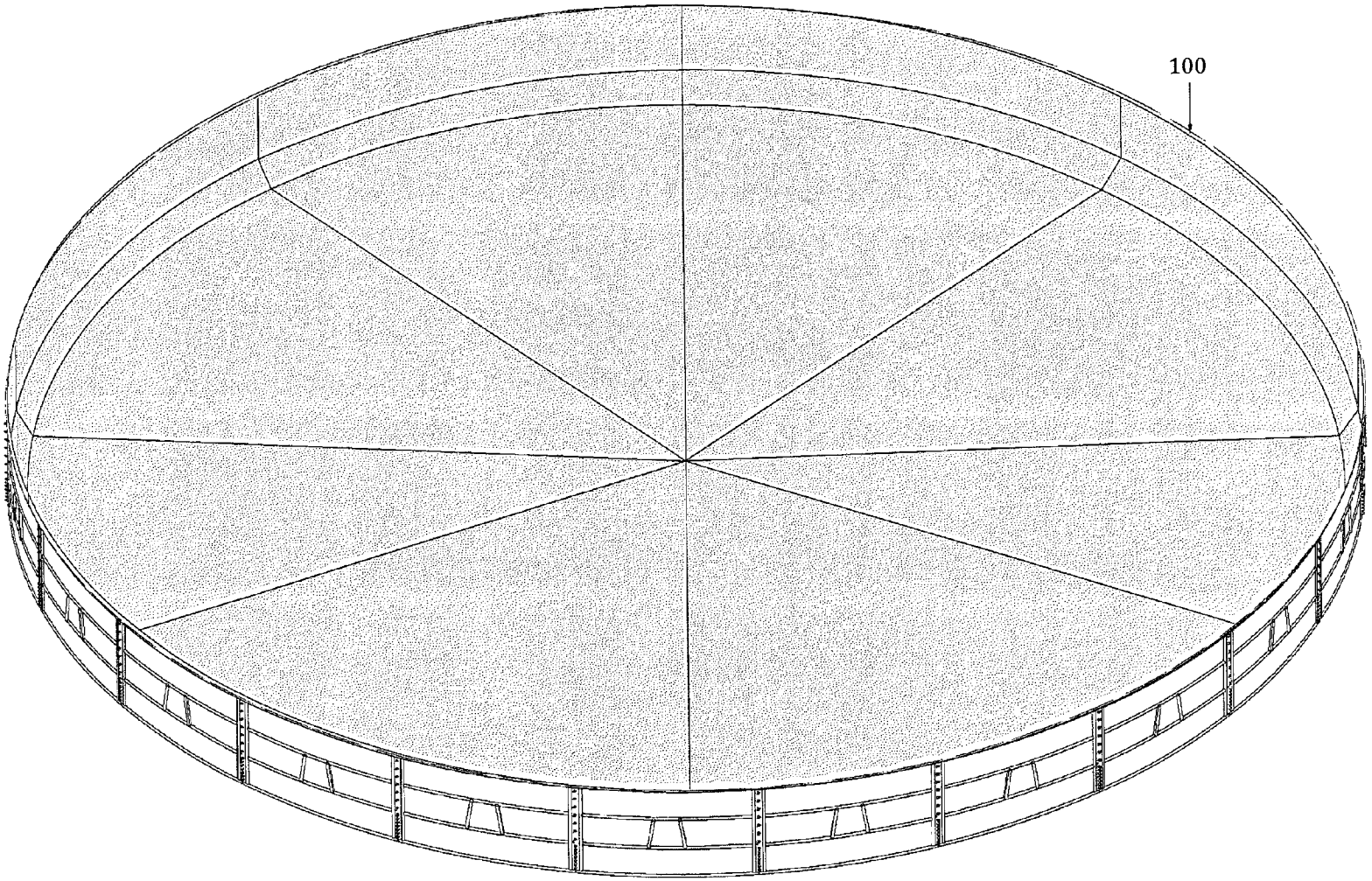
FIG. 10 illustrates a perspective view of one embodiment of the present invention further showing a liner covering the inner surface of the reservoir frame and the bottom of the reservoir as shown in FIG. 9.

FIG. 10 shows a liner 105 covering the inner surface of the reservoir frame and the bottom of the reservoir.

Figure 11:
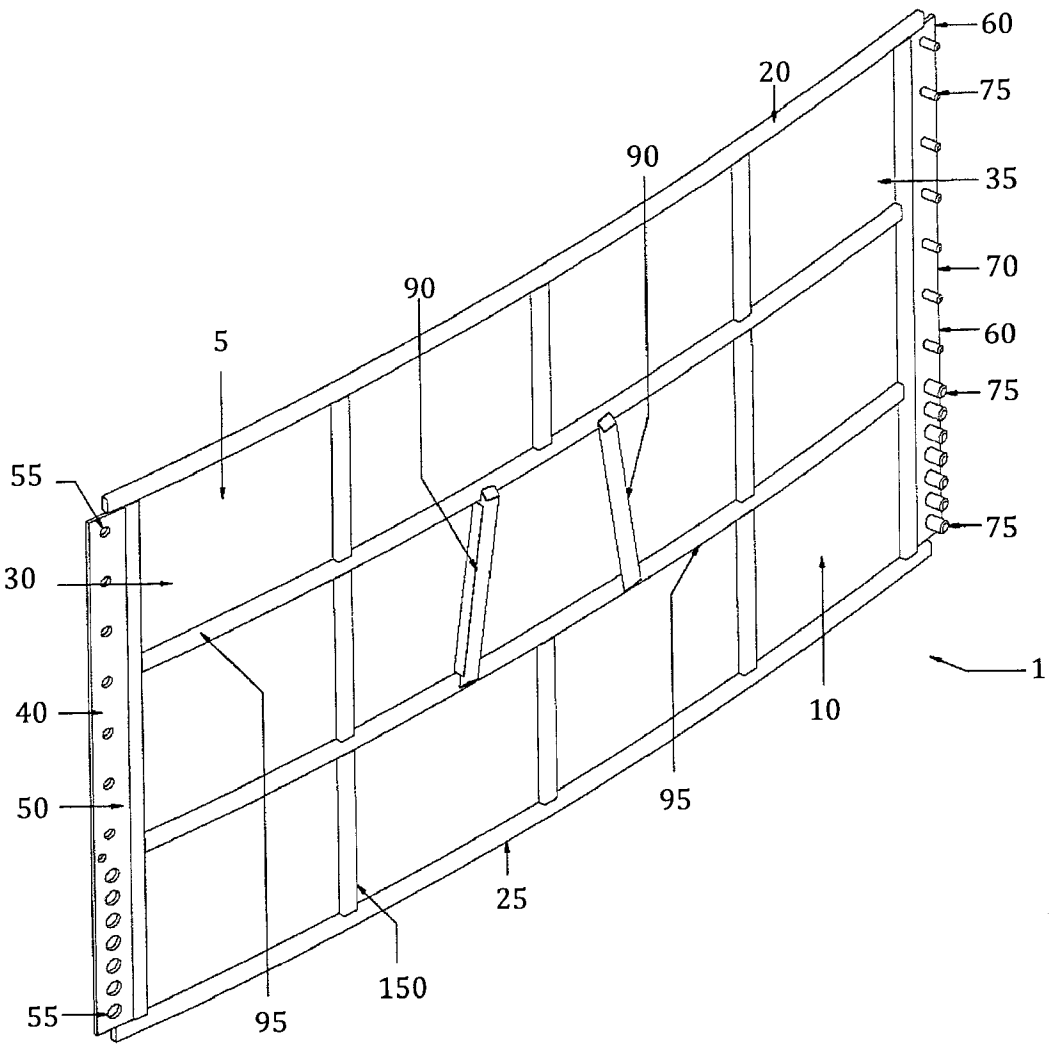
FIG. 11 illustrates a perspective view of one embodiment of the present invention showing panels having additional support beams.

FIG. 11 illustrates a perspective view of one embodiment of the present invention showing panels having vertical support beams 150. Such vertical support beams further secure and support the reservoir panel 1 and plate 5 in order to hold and contain large amounts of liquid in the reservoir frame.

Figure 12:
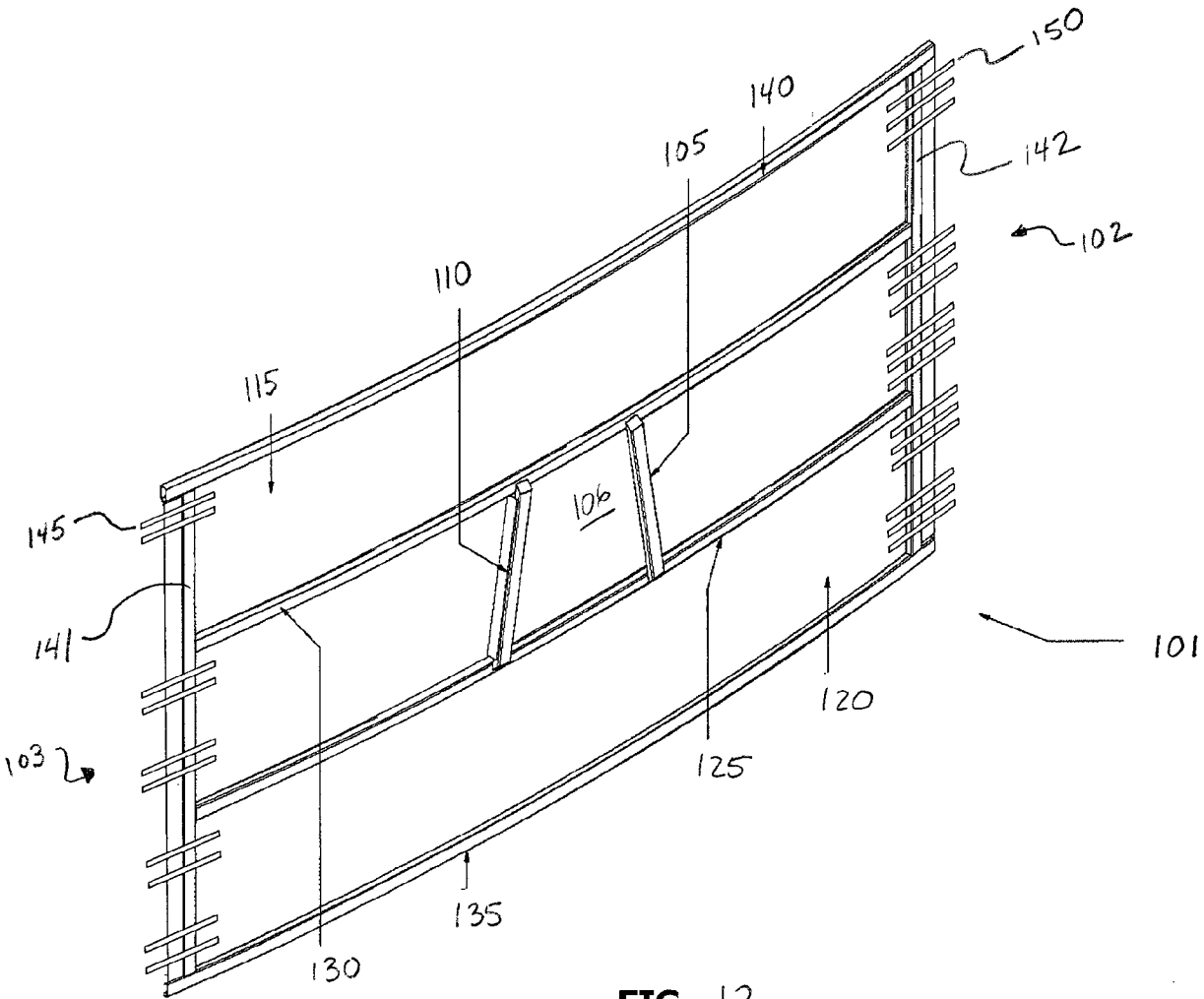
FIG. 12 illustrates a front perspective view of one embodiment of a panel having an outer surface, a plurality of knuckle members and top edge.
Figure 13:
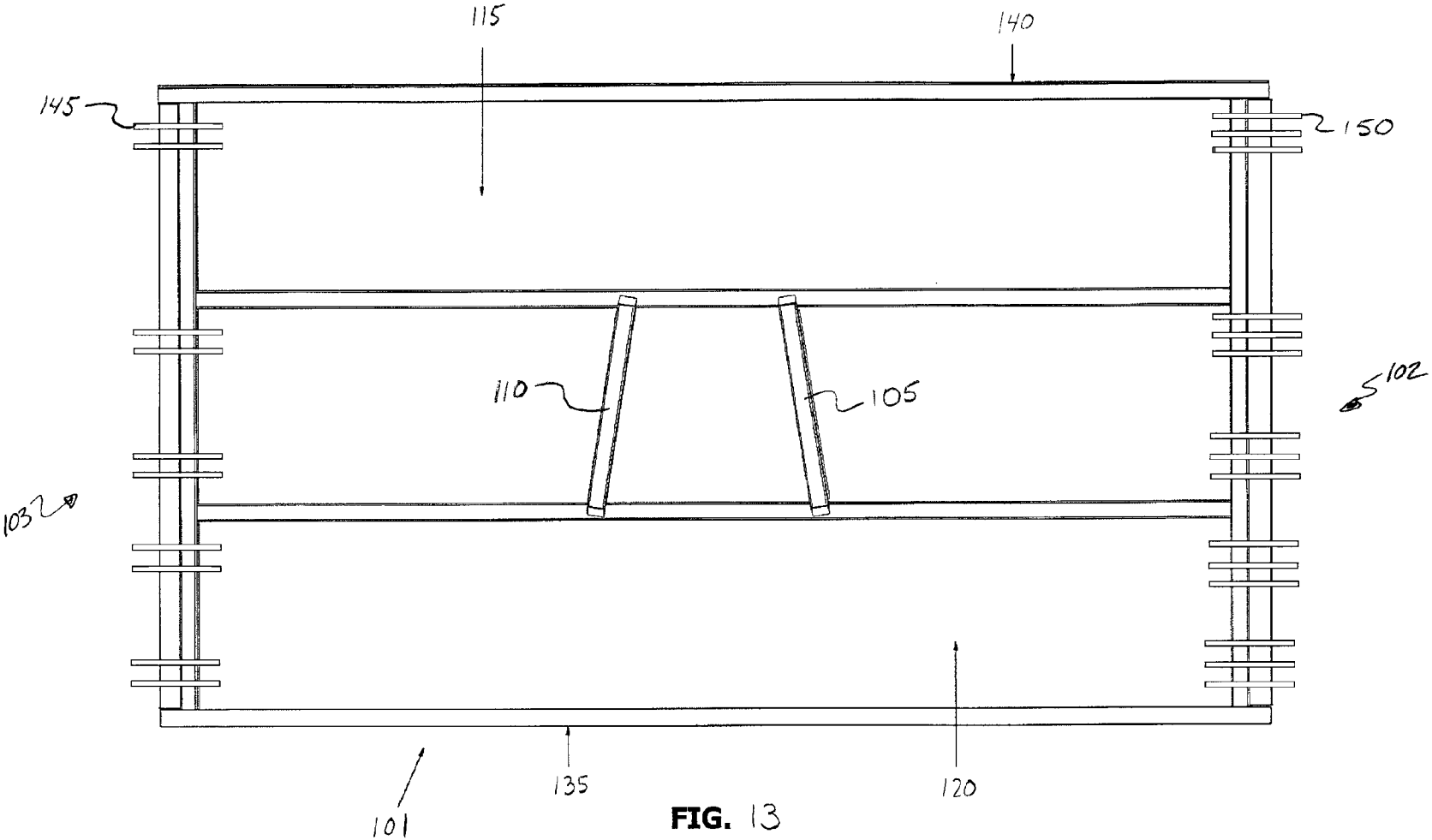
FIG. 13 illustrates a front view of the embodiment illustrated in FIG. 12.

FIGS. 12 and 13 illustrate a front view and front perspective view of an alternate embodiment of a panel 101. As shown in the illustrated embodiment, panel 101 is comprised of a plate 115. The plate 115 has an outer surface 120, and includes a bottom edge 135, and a top edge 140. Bottom edge and top edge are typically manufactured of square steel and secured to the outer surface 120 in a suitable manner, such as welding or the like. The bottom edge 135 of panel 101 is configured to rest on the surface of the ground. Panel 101 is fitted with a plurality of horizontal support beams 125, 130 for providing additional support and strength to the panel. Vertical support beams (not shown) may also be provided for additional strength and support.

In addition, FIGS. 12 and 13 illustrate crossbars 105, 110 that are configured and used to removably couple the panel 101 temporarily to a quick attachment plate (for example, the quick attachment plate illustrated in FIG. 18, and further described herein) of a lifting device for transportation during an installation process. Any suitable device may be used for a lifting device such as, for example, a front-end loader, boom lift or telehandler to name a few. Thus, the lifting device can easily manipulate and transport a panel during reservoir frame construction. In one embodiment, the crossbars 105, 110 may be attached to the outer surface 115 of the panel 101 in a trapezoidal configuration as shown. The trapezoidal configuration is the same shape as the quick attachment plate illustrated and described with respect to FIG. 18. One of ordinary skill in the art will recognize and appreciate that any shape of the crossbar/quick attachment plate may be used that is sufficient to support the weight of the panel when lifted and transported by the lifting device. The horizontal support beams 125, 130 are generally parallel to the top edge 140 and the bottom edge 135, and the horizontal support beams are disposed between the vertical framing member 141 and opposing vertical framing member 142. In another embodiment the crossbars 105, 110 may be attached to the horizontal support beams 125, 130.

In the illustrated embodiment, on a first side 103 of panel 101, a plurality of knuckle members 145 are secured to the vertical framing member 141. On a second side 102 of panel 101, a plurality of knuckle members 150 are secured to the vertical framing member 142. In operation, the knuckle members secured to the first side 103 and second side 102 of adjacent panels 101 are configured to be alternately interleaved in a manner as shown in FIG. 12A. In the illustrated example, adjacent panel members are then secured together by inserting a rod or similar structure into a hole drilled into the top of each knuckle member 145, 150. As one of ordinary skill in the art will appreciate, any suitable method may be used to secure the knuckle members 145 of one panel to the knuckle members 150 of an adjacent panel without departing from the scope and spirit of the invention.

Figure 14:
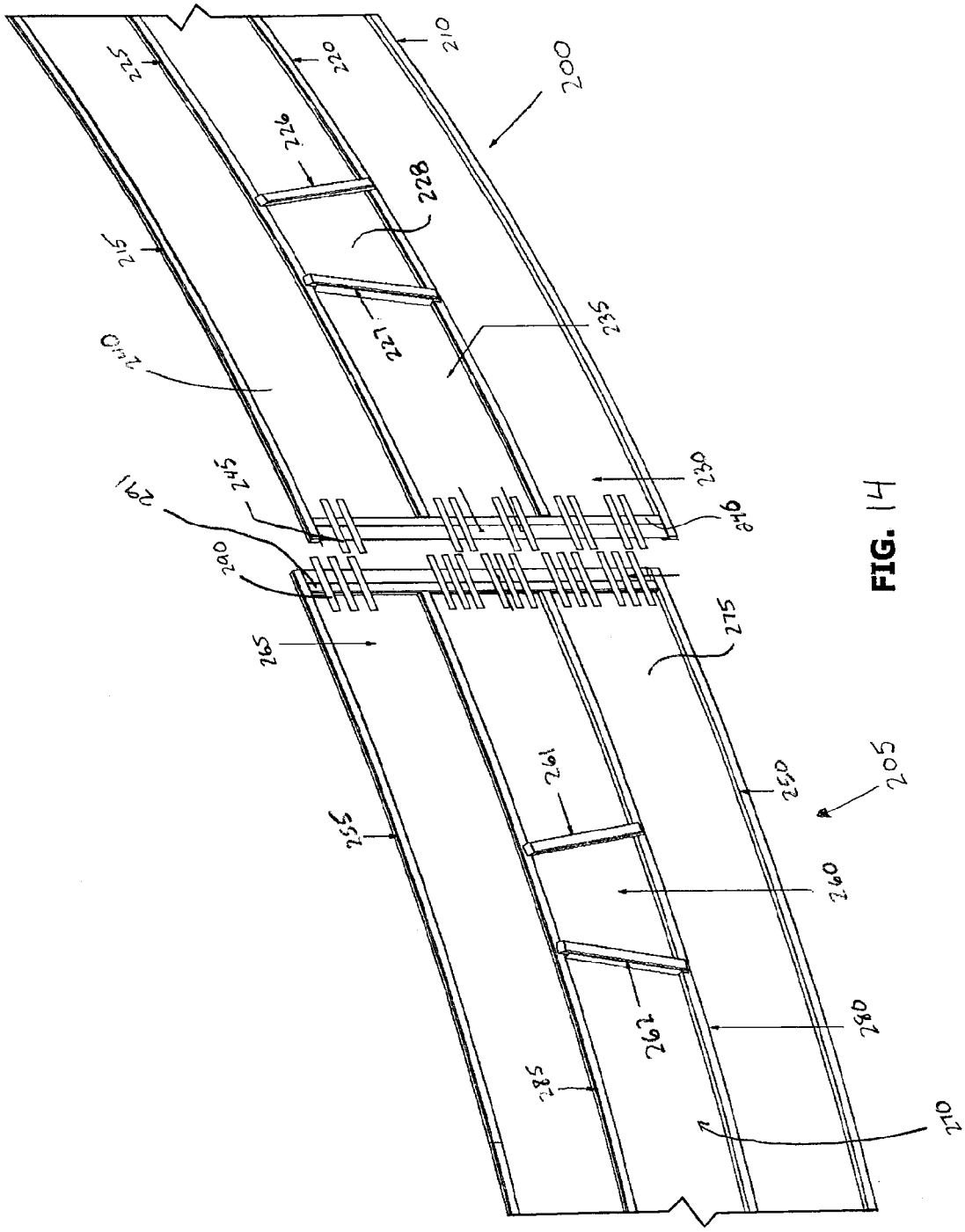
FIG. 14 illustrates a front perspective view of adjacent panels prior to securing them together.
Figure 15:
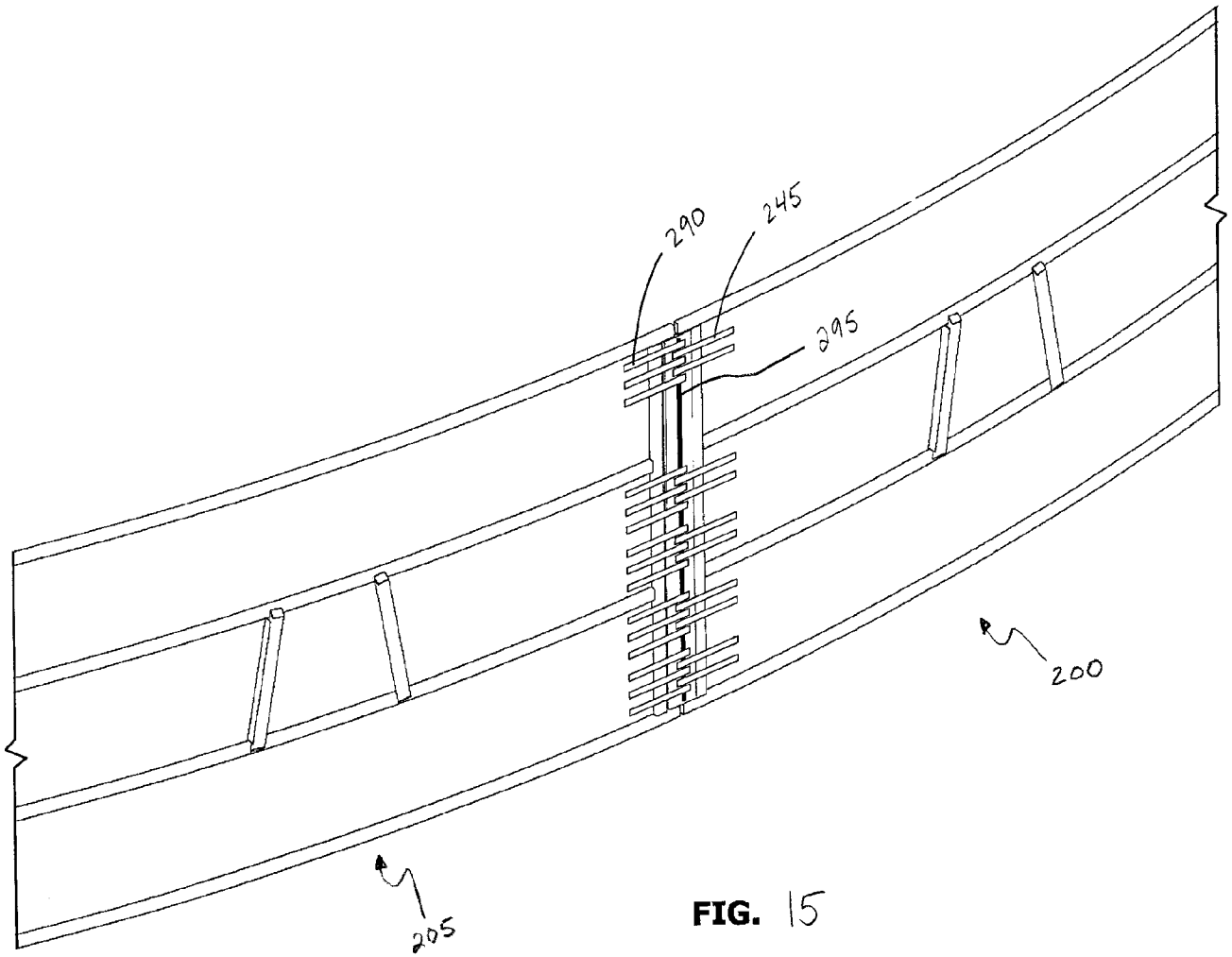
FIG. 15 illustrates a front perspective view of adjacent panels secured together using interleaved knuckle members and a securing member running through a hole located in each knuckle member.
Figure 15A:
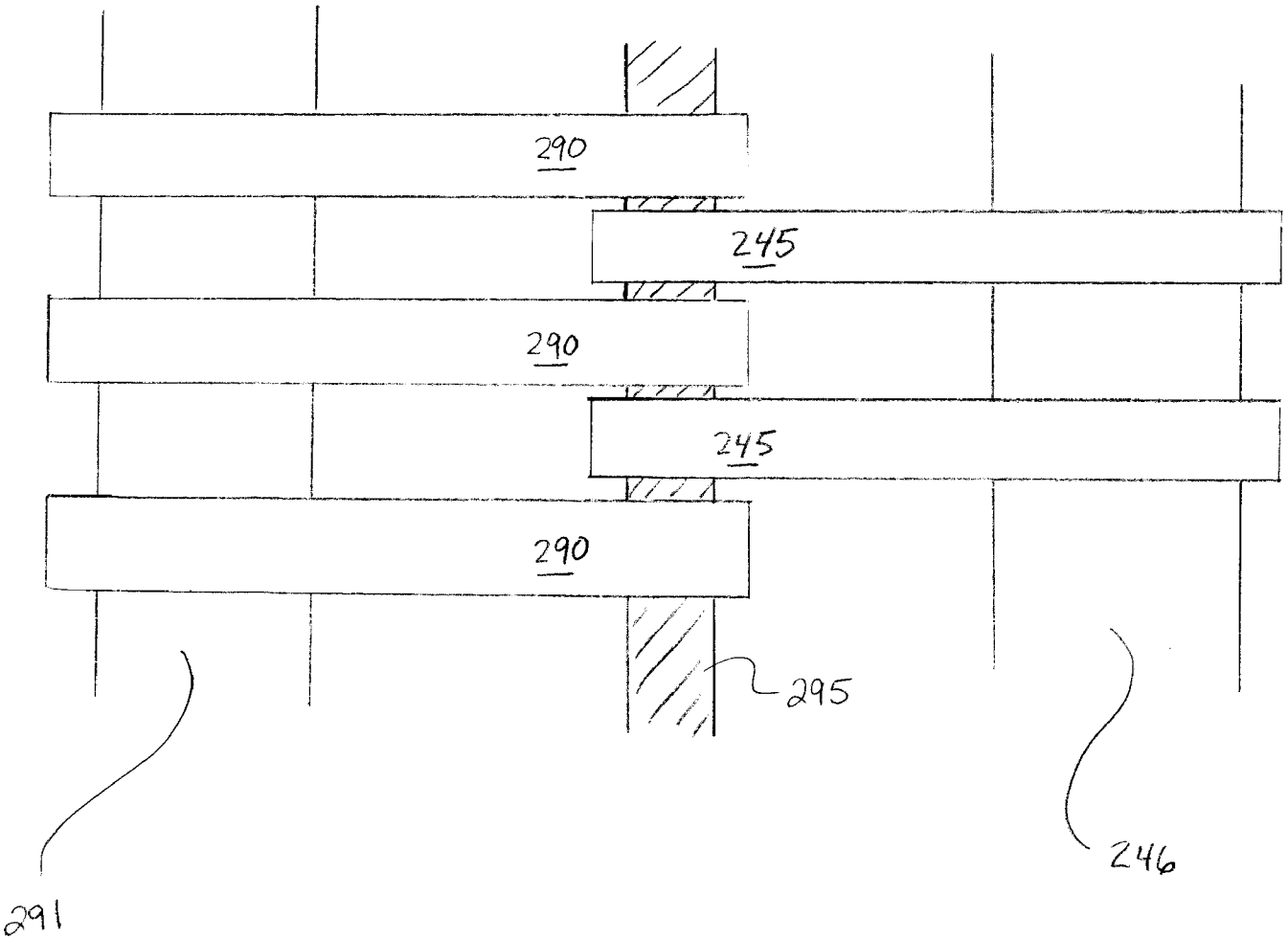
FIG. 15A illustrates a close-up view of the interleaved knuckle members of adjacent panels incorporating the securing member.
Figure 16:
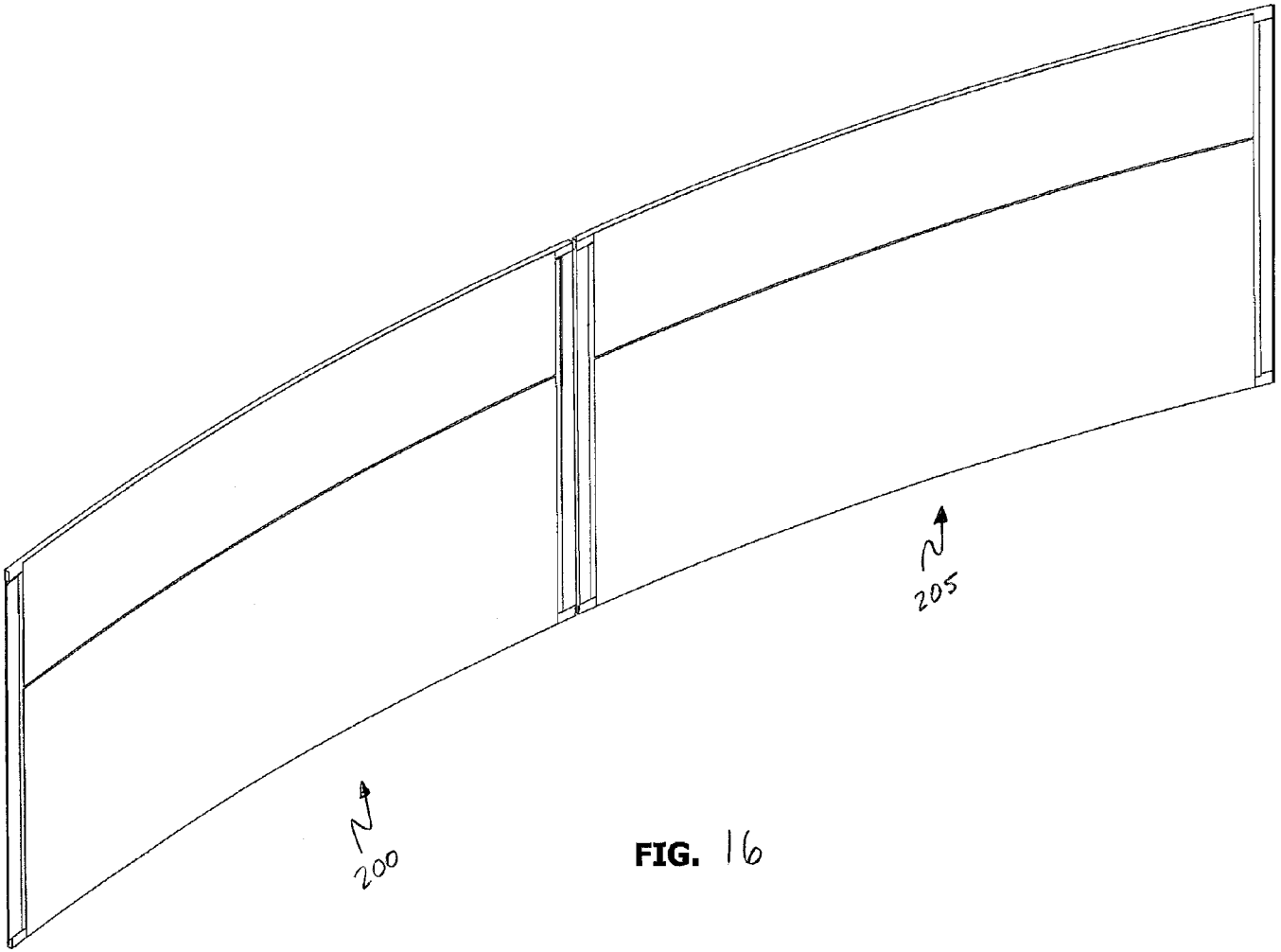
FIG. 16 illustrates the interior surface of adjacent panels coupled together using the interleaved knuckle members.

FIG. 14 illustrates adjacent panels 200, 205 in position prior to joining together using the interleaved knuckle members 245, 290 of adjacent panels. Similar to the embodiment shown in FIGS. 12 and 13, panel 200 is comprised of a plate 235. The plate 235 has an outer surface 240, and includes a bottom edge 210, and a top edge 215. Panel 200 is fitted with a plurality of horizontal support beams 220, 225. A plurality of knuckle members 245 are secured to the vertical framing member 246. Adjacent panel 205 is comprised of a plate 270. The plate 270 has an outer surface 265, and includes a bottom edge 250, and a top edge 255. Panel 205 is fitted with a plurality of horizontal support beams 261, 262. A plurality of knuckle members 290 are secured to the vertical framing member 291. As shown in FIG. 15, which further depicts the illustrated embodiment of FIG. 14, the knuckle members 245, 290 on adjacent panel members 200, 205 respectively are configured to be interleaved and secured with a steel rod 295, steel bar or similar securing member. FIG. 16 illustrates the interior view of two adjacent panels secured together using the interleaved knuckle members 245, 290 and rod member 295.

In one embodiment of the present invention the panels 200, 205 have a curvature such that when multiple panels are interconnected via the interleaving of knuckle members 245 and knuckle members 290 on adjacent panel members secured together with a rod member or the equivalent, a generally circular reservoir frame system is constructed. The curvature of panels 200, 205 are generally convex relative to the outer surface (as shown in FIG. 15) and generally concave relative to the inner surface (as shown in FIG. 16).

Figure 17:
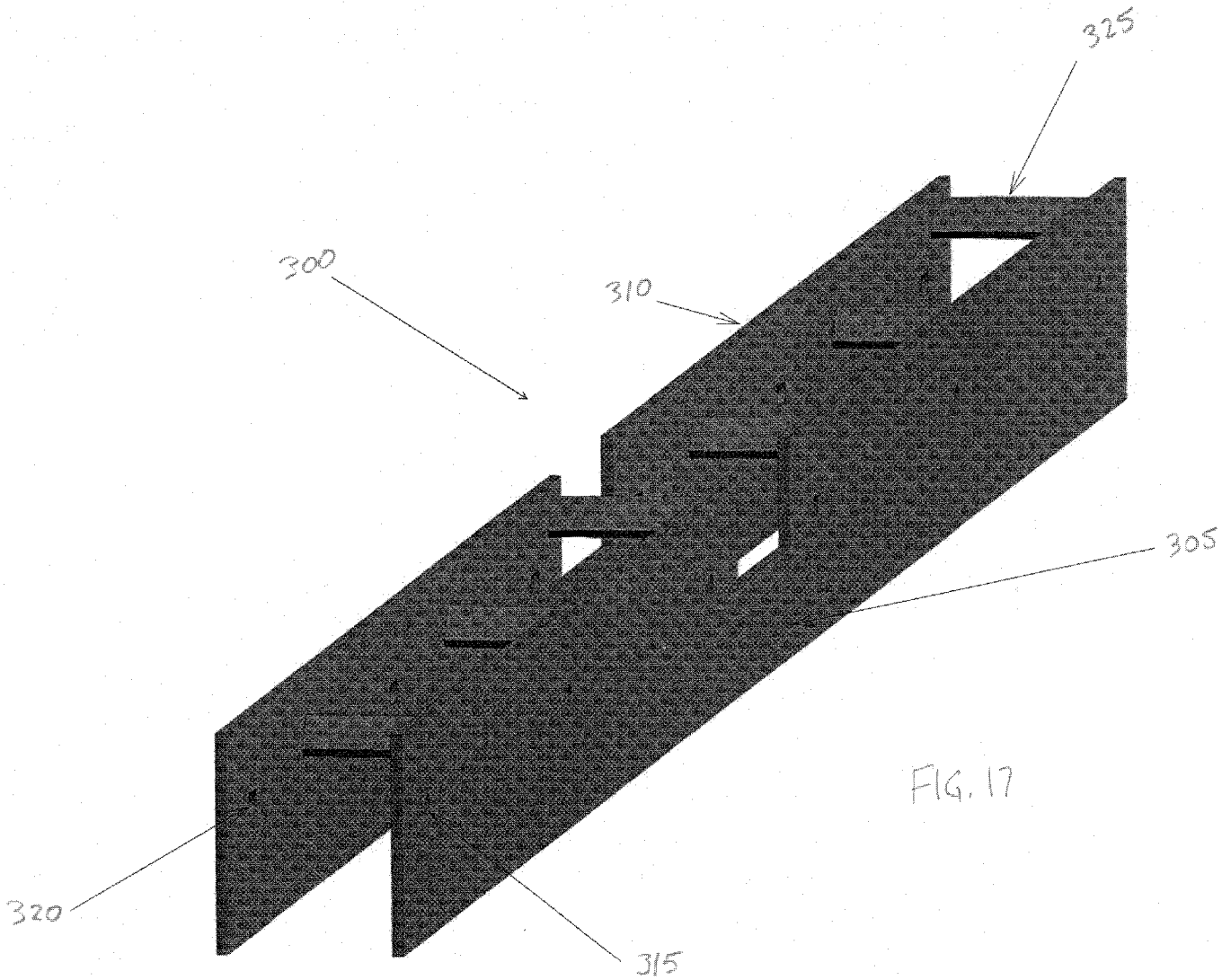
FIG. 17 illustrates a front perspective view of a tank support clip.

FIG. 17 illustrates one embodiment of a tank support clip 300. In connection with the illustrated embodiment shown in FIGS. 12 and 13, tank support clip 300 is configured to be placed on the top edge 140 of panel 101 to secure a tank liner 100 (shown in FIG. 10). Tank support clip 300 is comprised of a first side member 305 and second side member 310 secured together by a number of support bars 325 secured to the interior surface of each side member. Typically, the tank support clip is manufactured from steel, however, any suitable material may be used without departing from the scope and spirit of the invention. In operation, the support bars 325 are configured to rest on the top edge 140 of panel 101 and the weight of the tank support clip secures the tank liner 100 in place.

Figure 18:
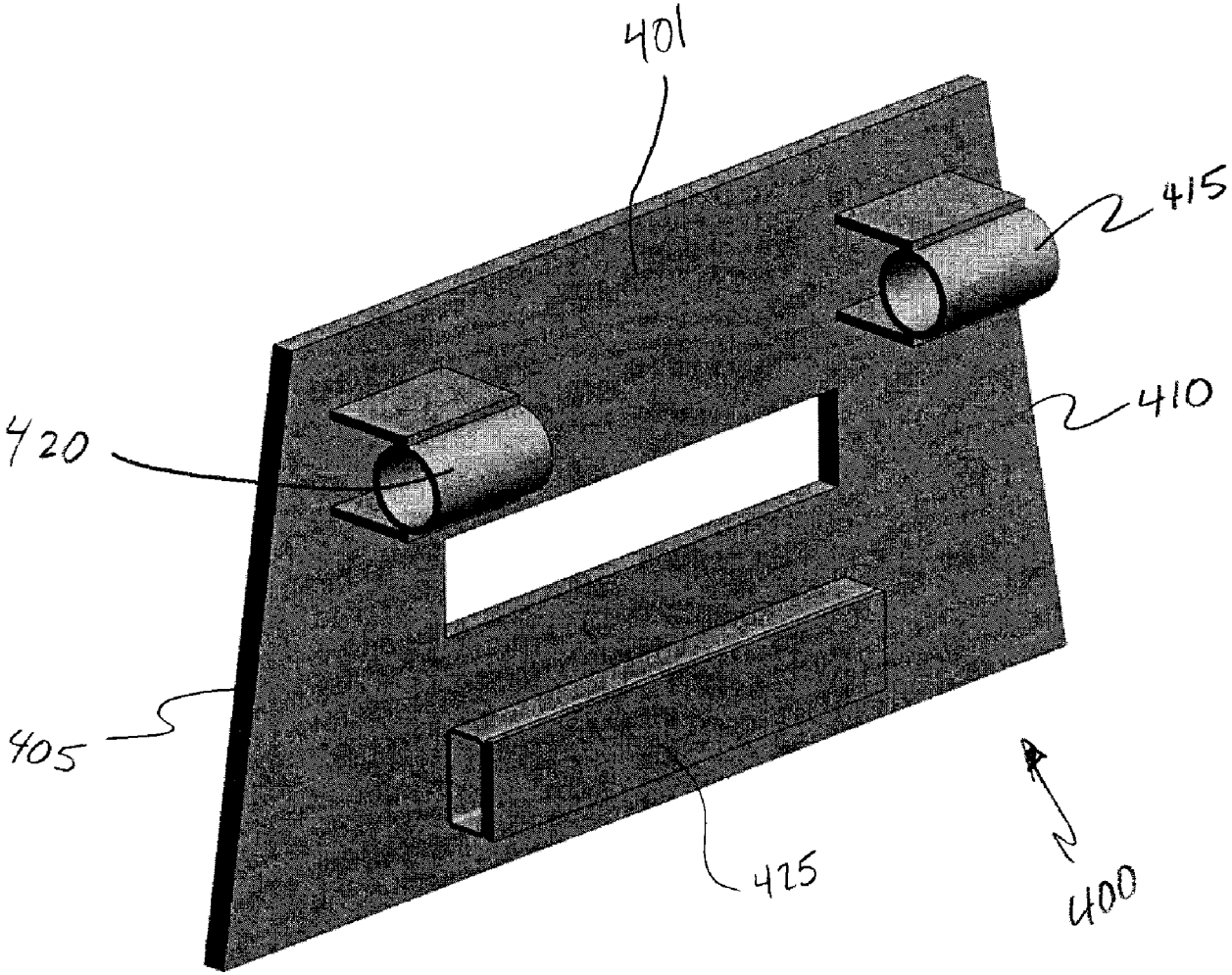
FIG. 18 illustrates a front perspective view of a quick attachment plate.

FIG. 18 illustrates one embodiment of a quick attachment plate 400. Quick attachment plate is comprised of a plate member 401. In one embodiment, plate member has an angled left side 405 and an angled right side 410 so as to form the approximate shape of a trapezoid. Quick attachment plate 400 is fitted with a number of quick release member 415, 420, 425 that are configured to be connected to a front-end loader, boom lift or telehandler so as to manipulate and transport panels of the present invention.

In operation, quick attachment plate 400 is constructed and configured to be connected to a lifting device for transporting a panel, for example, panel 101 illustrated in FIGS. 12 and 13. The trapezoidal shape of quick attachment plate 400 formed by angled left side 405 and angled right side 410 is designed to fit securely within the space 106 formed by crossbars 105, 110. Once securely within the space 106 between the crossbars 105, 110, the front-end loader, boom lift or telehandler may then use the quick attachment plate 400 to lift the panel 101 and move it to any position the operator desires.

Figure 19:
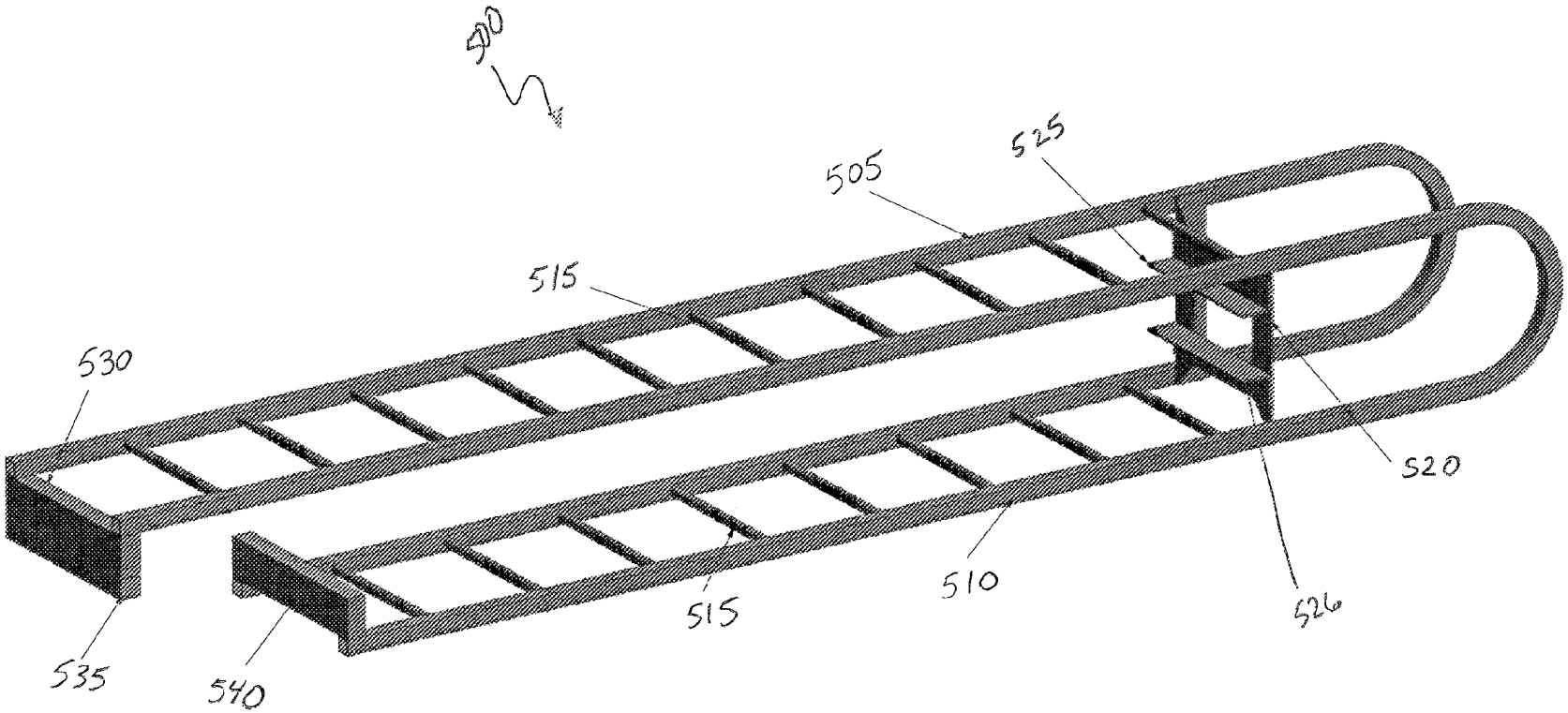
FIG. 19 illustrates a front perspective view of a ladder.

FIG. 19 illustrates a ladder to be used in conjunction with the illustrated embodiments of the present invention. In one embodiment, ladder 500 is comprised of a first side 510 and a second side 515. First side 510 and second side 515 each are further comprised of a plurality of steps 515. The top portion of the ladder 500 has a platform 520 that is further comprised of a pair of plates 525, 526 secured thereto. In operation, the plates 525, 526 are spaced sufficiently apart such that the ladder 500 may be secured to the top edge 140 of panel 101 by positioning the two plates 525, 526 on either side of the top edge 140 and supporting the underside of the platform 520 on the top edge 140 of the panel 101. For additional stability, ladder 500 is provided with securing members 530, 535, 540 that rest against the interior and exterior of the panel member 101.

It is believed that the apparatus of the present invention and many of its attendant advantages will be understood from the foregoing description. It is also believed that it will be apparent that various changes may be made in the form, construction, and arrangement of the components without departing from the scope and spirit of the invention and without sacrificing its material advantages. The forms described are merely exemplary and explanatory embodiments thereof. It is the intention of the following claims to encompass and include such changes.

We claim:

1. A portable reservoir frame comprising:

two or more interconnecting panels, each panel comprising, a plate having an outer surface, an inner surface, a top edge, a bottom edge, a first edge and a second edge, a first plurality of knuckle members secured to the first edge of the plate, the first plurality of knuckle members having at least one hole for receiving a securing member, a second plurality of knuckle members secured to the second edge of the plate, the second plurality of knuckle members having at least one hole for receiving a securing member, the second plurality of knuckle members of a panel configured to be interleaved with the first plurality of knuckle members of an adjacent panel of the reservoir frame and secured with a plurality of securing members sized to fit within the at least one hole of each knuckle member of the first plurality and the second plurality of knuckle members, a first plurality of groupings of the first plurality of knuckle members, a second plurality of groupings of the second plurality of knuckle members, wherein each grouping of the first plurality of groupings of a panel is configured to be interleaved with a corresponding grouping of the second plurality of groupings of an adjacent panel to form a plurality of interleaved groupings that secure the panel to the adjacent panel, each of the plurality of interleaved groupings configured to receive one of the plurality of securing members, and wherein adjacent interleaved groupings have a gap there between sized to allow one of the plurality of securing members to fit between the gap so as be inserted into one of the plurality of interleaved groupings.

2. The portable reservoir of claim 1, wherein the securing member is a steel rod.

3. The portable reservoir of claim 1, wherein the panel further comprises a first vertical framing member secured to the first edge and a second vertical framing member secured to the second edge, and wherein the first plurality of knuckle members are secured to the first vertical framing member and the second plurality of knuckle members are secured to the second vertical framing member.

4. The portable reservoir of claim 3, further comprising a plurality of horizontal support beams and vertical support beams secured to the outer surface of the panel.

5. A method of constructing a portable reservoir frame comprising:

providing a plurality of panels, each panel comprising, a plate having an outer surface, an inner surface, a top edge, a bottom edge, a first edge and a second edge, a first plurality of knuckle members secured to the first edge of the plate, the first plurality of knuckle members having at least one hole for receiving a securing member, a second plurality of knuckle members secured to the second edge of the plate, the second plurality of knuckle members having at least one hole for receiving a securing member, the second plurality of knuckle members of a panel configured to be interleaved with the first plurality of knuckle members of an adjacent panel of the reservoir frame and secured with a securing member sized to fit within the at least one hole of each knuckle member of the first plurality and the second plurality of knuckle members, a first plurality of groupings of the first plurality of knuckle members, a second plurality of groupings of the second plurality of knuckle members, wherein each grouping of the first plurality of groupings of a panel is configured to be interleaved with a corresponding grouping of the second plurality of groupings of an adjacent panel to form a plurality of interleaved groupings that secure the panel to the adjacent panel, each of the plurality of interleaved groupings configured to receive one of the plurality of securing members, and wherein adjacent interleaved groupings have a gap there between sized to allow one of the plurality of securing members to fit between the gap so as to be inserted into one of the plurality of interleaved groupings;

positioning two panels of the plurality of panels adjacent one another;

interleaving the first plurality of knuckle members of a panel with the second plurality of knuckle members of an adjacent panel;

inserting one of the plurality of securing members into one of the plurality of interleaved groupings for each interleaved grouping of the plurality of interleaved groupings to secure the adjacent panels; and repeating the steps of positioning, interleaving and inserting until the portable reservoir frame is fully constructed.

6. The method of claim 5, further comprising providing a liner to line the interior of the portable reservoir frame so as to be able to retain liquid within the interior of the portable reservoir frame.

7. The method of claim 6, further comprising providing a tank support clip that secures to the top edge of the panel for securing the liner to the portable reservoir frame.

8. The method of claim 5, further comprising providing a ladder that secures to the top edge of the panel for accessing the interior of the portable reservoir frame.

9. A method of constructing a portable reservoir frame comprising:

providing a plurality of panels, each panel comprising, a plate having an outer surface, an inner surface, a top edge, a bottom edge, a first edge and a second edge, a first plurality of knuckle members secured to the first edge of the plate, the first plurality of knuckle members having at least one hole for receiving a securing member, a second plurality of knuckle members secured to the second edge of the plate, the second plurality of knuckle members having at least one hole for receiving a securing member, the second plurality of knuckle members of a panel configured to be interleaved with the first plurality of knuckle members of an adjacent panel of the reservoir frame and secured with a securing member sized to fit within the at least one hole of each knuckle member of the first plurality and the second plurality of knuckle members, a first plurality of groupings of the first plurality of knuckle members, a second plurality of groupings of the second plurality of knuckle members, wherein each grouping of the first plurality of groupings of a panel is configured to be interleaved with a corresponding grouping of the second plurality of groupings of an adjacent panel to form a plurality of interleaved groupings that secure the panel to the adjacent panel, each of the plurality of interleaved groupings configured to receive one of the plurality of securing members, and wherein adjacent interleaved groupings have a gap there between sized to allow one of the plurality of securing members to fit between the gap so as to be inserted into one of the plurality of interleaved groupings, a plurality of horizontal support beams secured to the outer surface of the plate, the support beams aligned generally parallel with the top edge and bottom edge of the plate and extending from the first edge to the second edge, and a plurality of crossbars secured to the outer surface of the and the horizontal support beams, the plurality of crossbars configured for receiving a quick attachment plate for lifting and moving the panel, the plurality of crossbars aligned generally in a direction from the top edge to the bottom edge of the plate and arranged to tightly contact a first and second lateral side of the quick attachment plate to allow the quick attachment plate to assist in the lifting of the panel;

removably coupling a quick attachment plate coupled to a lifting device with the plurality of crossbars secured to the outer surface of a panel;

lifting the panel with the lifting device;

positioning the panel adjacent another panel of the plurality of panels;

interleaving the first plurality of knuckle members of the panel with the second plurality of knuckle members of the adjacent panel;

inserting one of the plurality of securing members into one of the plurality of interleaved groupings for each interleaved grouping of the plurality of interleaved groupings to secure the adjacent panels; and repeating the steps of coupling, lifting, positioning, interleaving and inserting until the portable reservoir frame is fully constructed.

10. The method of claim 9, wherein the lifting device is a telehandler.

11. The method of claim 9, wherein the lifting device is a boom lift.

12. A portable reservoir comprising:

a plurality of panels coupled together to form a portable reservoir frame for the portable reservoir, each panel comprising, a plate having an outer surface, an inner surface, a top edge, a bottom edge, a first edge and a second edge, a first plurality of knuckle members secured to the first edge of the plate, the first plurality of knuckle members having at least one hole for receiving a securing member, a second plurality of knuckle members secured to the second edge of the plate, the second plurality of knuckle members having at least one hole for receiving a securing member, the second plurality of knuckle members of a panel configured to be interleaved with the first plurality of knuckle members of an adjacent panel of the reservoir frame and secured with a plurality of securing members sized to fit within the at least one hole of each knuckle member of the first plurality and the second plurality of knuckle members, a first plurality of groupings of the first plurality of knuckle members, a second plurality of groupings of the second plurality of knuckle members, wherein each grouping of the first plurality of groupings of a panel is configured to be interleaved with a corresponding grouping of the second plurality of groupings of an adjacent panel to form a plurality of interleaved groupings that secure the panel to the adjacent panel, each of the plurality of interleaved groupings configured to receive one of the plurality of securing members, and wherein adjacent interleaved groupings have a gap there between sized to allow one of the plurality of securing members to fit between the gap so as to be inserted into one of the plurality of interleaved groupings, and a plurality of horizontal support beams secured to the outer surface of the plate, the horizontal support beams aligned substantially parallel with the top edge and bottom edge of the plate and extending from the first edge to the second edge;

a liner for retaining water within the interior of the portable reservoir; and a tank support clip secured to the top edge of the panel for securing the liner to the portable reservoir frame.

13. The portable reservoir of claim 12, wherein the panel further comprises a first vertical framing member secured to the first edge and a second vertical framing member secured to the second edge, and wherein the first plurality of knuckle members are secured to the first vertical framing member and the second plurality of knuckle members are secured to the second vertical framing member.

14. The portable reservoir of claim 12, further comprising a ladder removably securable to the top edge of the panel for accessing the interior of the portable reservoir frame.

15. The portable reservoir of claim 1, further comprising a plurality of securing members configured for securing one or more interleaved groupings of knuckle members of adjacent panels.

16. The portable reservoir of claim 1, further comprising a plurality of crossbars secured to the outer surface of the plate, the plurality of crossbars configured for receiving a quick attachment plate for lifting and moving the panel, the plurality of crossbars aligned generally in a direction from the top edge to the bottom edge of the plate and arranged to tightly contact a first and second lateral side of the quick attachment plate to allow the quick attachment plate to assist in the lifting of the panel.

17. The portable reservoir of claim 1, wherein the plurality of crossbars are arranged to receive a quick attachment plate that is shaped like a trapezoid.

18. The portable reservoir of claim 12, further comprising a plurality of securing members configured for securing one or more interleaved groupings of knuckle members of adjacent panels.

19. The portable reservoir of claim 12, further comprising a plurality of crossbars secured to the outer surface of the plate, the plurality of crossbars configured for receiving a quick attachment plate for lifting and moving the panel, the plurality of crossbars aligned generally in a direction from the top edge to the bottom edge of the plate and arranged to tightly contact a first and second lateral side of the quick attachment plate to allow the quick attachment plate to assist in the lifting of the panel.

20. The portable reservoir of claim 19, wherein the plurality of crossbars are arranged to receive a quick attachment plate that is shaped like a trapezoid.

* * * * *